US009399198B2

(12) United States Patent
Grant

(10) Patent No.: US 9,399,198 B2
(45) Date of Patent: Jul. 26, 2016

(54) VENTURI EJECTOR FOR A CHEMICAL DISPENSER

(71) Applicant: Sunburst Chemicals, Inc., Bloomington, MN (US)

(72) Inventor: Robert Grant, Eden Prairie, MN (US)

(73) Assignee: Sunburst Chemicals, Inc., Bloomington, MN (US)

( * ) Notice: Subject to any disclaimer, the term of this patent is extended or adjusted under 35 U.S.C. 154(b) by 225 days.

(21) Appl. No.: 13/650,617

(22) Filed: Oct. 12, 2012

(65) Prior Publication Data

US 2014/0102543 A1 Apr. 17, 2014

(51) Int. Cl.

| | |
|---|---|
| ***B01F 15/02*** | (2006.01) |
| ***B01F 1/00*** | (2006.01) |
| ***B01F 5/04*** | (2006.01) |
| ***F04F 5/20*** | (2006.01) |

(52) U.S. Cl.

CPC ..... *B01F 5/043* (2013.01); *B01F 15/0284* (2013.01); *F04F 5/20* (2013.01); *B01F 1/00* (2013.01); *B01F 1/0027* (2013.01); *Y10T 137/0329* (2015.04); *Y10T 137/2599* (2015.04)

(58) Field of Classification Search

CPC ..... B01F 5/0413; B01F 5/043; B01F 5/045; B01F 5/0498; B01F 15/0248; B01F 15/0254; B01F 15/0284; B01F 1/00; B01F 1/0027; F04F 5/20; Y10T 137/2599; Y10T 137/0329; B01D 11/02; B01D 11/0215

USPC ..... 417/151; 366/163.2, 165.1, 165.5; 422/261, 266; 137/268; 222/52

See application file for complete search history.

(56) References Cited

U.S. PATENT DOCUMENTS

| | | | | | |
|---|---|---|---|---|---|
| 1,755,437 | A | * | 4/1930 | Fazio | 366/142 |
| 2,005,800 | A | * | 6/1935 | O'Boyle | 366/173.1 |
| 2,704,241 | A | | 3/1955 | Gannon | |
| 2,785,012 | A | * | 3/1957 | Frewin | 239/310 |
| 2,795,403 | A | * | 6/1957 | Mead | 366/107 |
| 3,542,342 | A | * | 11/1970 | Barron | 366/178.1 |
| 3,595,395 | A | | 7/1971 | Lorenzen | |
| 3,615,244 | A | | 10/1971 | Long et al. | |
| 4,210,166 | A | * | 7/1980 | Munie | 137/271 |
| 4,250,910 | A | | 2/1981 | King | |
| 4,357,953 | A | | 11/1982 | Patterson | |
| 4,390,284 | A | * | 6/1983 | Hyde et al. | 366/165.5 |
| 4,426,156 | A | * | 1/1984 | Adamo et al. | 366/156.1 |
| 4,426,362 | A | | 1/1984 | Copeland et al. | |
| 4,444,730 | A | | 4/1984 | Renders et al. | |
| 4,463,582 | A | | 8/1984 | Saalmann et al. | |
| 4,687,121 | A | | 8/1987 | Copeland | |
| 4,690,305 | A | | 9/1987 | Copeland | |
| RE32,818 | E | | 1/1989 | Fernholz et al. | |
| 4,826,661 | A | | 5/1989 | Copeland et al. | |
| 4,858,449 | A | | 8/1989 | Lehn | |

(Continued)

*Primary Examiner* — Devon Kramer
*Assistant Examiner* — Nathan Zollinger
(74) *Attorney, Agent, or Firm* — Patterson Thuente Pedersen, P.A.

(57) ABSTRACT

A venturi ejector for forcibly ejecting a slurry or solution generated in a fluid dispenser, wherein the venturi ejector includes a venturi, the venturi being in a first flow communication with the slurry or solution and developing a vacuum, the vacuum being in a second flow communication with atmospheric pressure, the second flow communication acting to cause the atmospheric pressure to exert a pressure on the slurry or solution, thereby forcing the slurry to the venturi where the slurry or solution is forcibly ejected from the venturi. A method for forcibly ejecting a slurry or solution generated in a fluid dispenser is further included.

23 Claims, 4 Drawing Sheets

(56) References Cited

U.S. PATENT DOCUMENTS

| | | | | | |
|---|---|---|---|---|---|
| 4,884,925 | A | * | 12/1989 | Kemp et al. | 406/109 |
| 4,919,160 | A | * | 4/1990 | Pierce | 134/100.1 |
| 4,964,185 | A | | 10/1990 | Lehn | |
| 4,995,418 | A | | 2/1991 | Cervola | |
| 4,999,124 | A | | 3/1991 | Copeland | |
| 5,137,694 | A | | 8/1992 | Copeland et al. | |
| 5,147,615 | A | | 9/1992 | Bird et al. | |
| 5,194,230 | A | | 3/1993 | PeKarna et al. | |
| 5,195,851 | A | * | 3/1993 | Shepard et al. | 406/121 |
| 5,232,059 | A | * | 8/1993 | Peterson | 175/206 |
| 5,342,587 | A | | 8/1994 | Laughlin et al. | |
| 5,344,619 | A | * | 9/1994 | Larwick et al. | 422/261 |
| 5,384,102 | A | | 1/1995 | Ferguson et al. | |
| 5,417,233 | A | | 5/1995 | Thomas et al. | |
| 5,427,748 | A | | 6/1995 | Wiedrich et al. | |
| 5,549,875 | A | * | 8/1996 | Laughlin | A47K 5/08 137/268 |
| 5,607,651 | A | * | 3/1997 | Thomas et al. | 422/266 |
| 5,779,355 | A | * | 7/1998 | Pullman | 366/137 |
| 5,846,499 | A | * | 12/1998 | Laughlin et al. | 422/264 |
| 6,357,906 | B1 | * | 3/2002 | Baudoin et al. | 366/163.2 |
| 6,796,704 | B1 | * | 9/2004 | Lott | 366/163.2 |
| 6,869,529 | B2 | * | 3/2005 | Cerny | C02F 1/688 137/268 |
| 6,971,786 | B2 | * | 12/2005 | Krambrock | 366/165.1 |
| 7,201,290 | B2 | * | 4/2007 | Mehus | B01F 1/0027 222/77 |
| 8,813,769 | B2 | * | 8/2014 | Gastauer et al. | 137/12 |
| 2006/0223423 | A1 | * | 10/2006 | Dorfman et al. | 451/38 |

* cited by examiner

VENTURI EJECTOR FOR A CHEMICAL DISPENSER

TECHNICAL FIELD

The present invention relates to devices for dispensing a chemical solution. In particular, it relates to a dispenser that forms a detergent solution from a solid cast chemical.

BACKGROUND OF THE INVENTION

There is a need in industry today to provide a chemical solution that is ready to use when mixed and that is made from solid cast chemical. Solid cast chemical is essentially a chemical that is in solid form and cast in a preferably pliable, plastic container; it is effectively a bar of soap in a plastic container. Removal is typically done by dissolving the detergent in place in the container with a jet of water.

There are a number of advantages to using solid cast chemical as compared to liquid chemical. The first is safety. Since the chemical is cast inside of a container it is virtually impossible for personnel to come in contact with the chemical until it has been diluted. The U.S. Department of Transportation recognizes such chemical as safe to ship. If there is an accident, there is no liquid spillage to contaminate the ground water in the immediate area. The containers, even if cracked by the accident, retain the chemical and may simply be retrieved.

The concentration that is possible with solid cast chemical provides additional advantages. Such detergent is typically 100% active material as opposed to liquid which is between 40% and 5% active, with the remainder being water. A single capsule of solid chemical can do the same work as six to seven gallons of a typical liquid. A related advantage is the compactness of solid chemical that provides benefits when storing the chemical, shipping chemical, and when handling the chemical. The dramatic reduction in storage space is especially attractive to relatively small commercial establishments such as gas stations and fast food restaurants that have very little space to devote to storing cleaning supplies. Freight costs are also dramatically reduced since the cost of shipping water is eliminated. Other handling costs are also reduced since, for equal cleaning potential, substantially less weight and volume is being handled as compared to liquid chemical.

Another advantage of solid cast chemical is that it has an essentially indefinite shelf life. Very little can occur that can change the character of the product over time.

Solid cast chemicals are more environmentally sound than liquids. Studies have shown that "bag-in-a-box" and five gallon pail packaging of liquid chemicals actually have approximately four to five ounces of chemicals left when the package is considered empty and therefore is discarded. Raw chemicals are accordingly dumped into landfills when liquid chemical packages are discarded. Solid cast chemicals use approximately one sixth the volume of empty containers as a liquid system of equal cleaning capacity, and solid cast chemical containers are usually thoroughly rinsed of all chemical by water jet action before being discarded or recycled.

A further requirement of chemical dispensers is that the dispenser should preferably provide a ready to use solution. This requirement is a major concern for many commercial establishments. The portion of the labor pool that is utilized for cleaning functions is typically the lower skilled and less educated portion. Training of these employees is difficult and expensive. The fact that the solution is ready to use minimizes the training that is required for proper usage.

Another aspect of the training issue is that the dispenser should have a minimum number of controls and control operations necessary to obtain a container of properly mixed detergent solution. Ideally, the turning of a single valve would provide the solution.

Reliability is another desirable characteristic of a chemical dispenser. A minimum number of moving parts should be provided to minimize maintenance. The dispenser should also be small and be capable of being mounted on the wall, since the storage area for cleaning equipment in most commercial establishments is very small.

A further concern is that the chemical solution that is formed within the dispenser be isolated from the water supply, which in most cases is the water supply of the local municipality. There is considerable concern that in the event of a backup of the chemical solution in the dispenser, the chemical may be drawn into the water supply through the various plumbing that is in the dispenser. Accordingly, means must be devised to ensure that such contamination does not occur.

In the past, liquid chemical dispensers have been available that dispense a ready to use detergent solution. Additionally, solid cast chemical dispensers have been available. Drawing the concentrated chemical solution from the dispenser has proved to be a problem. When in the concentrated form, the chemical solution does not tend to flow freely and has a tendency to accumulate in the dispenser. If the solution remains in the bowl after water is turned off. The solution tends to solidify, thereby clogging the bowl In view of the foregoing, it would be a decided advantage to have a chemical dispenser that utilizes a solid cast chemical and that can positively discharge a ready to use concentration of chemical solution. The design should provide for transporting the solution over significant distances and at heights that exceed the height of the dispenser. In order to effect this, it would be helpful if the chemical solution was forcefully expressed for use.

U.S. Pat. No. 5,846,499, owned by the assignee of the present application, in part met the aforementioned needs. Flow from the bowl of the dispenser was enhanced, but was not forcefully expressed. Flow from the dispenser could not terminate at a height higher than the height of the dispenser and the flow must terminate close to the dispenser in order to ensure that the bowl was adequately purged.

SUMMARY OF THE INVENTION

The device of the present invention substantially meets the aforementioned needs. Further, by employing an integral venturi, more solution is pulled from the dispenser than can be dispensed by gravity alone. Because the venturi forcefully ejects solution from the bowl, collection of solution in the bowl after shut off of the dispenser is minimized, thereby minimizing the possibility that retained solution plugs the outlet of the bowl. Further, the improved flow resulting from employment of the venturi minimizes bowl overflows.

Flow from the dispenser of the present invention enhances flow beyond the limits of gravity feed. The venturi enhances the mixing of the driving fluid (bypass water) and the fluid/slurry being transferred. Additionally, The forceful ejection resulting form employment of the venturi permits the discharge of the bowl to be above the height of the bowl discharge point.

The use of the venturi is effective in simplifying the design of the dispenser. In the past, separate valves were need for the respective water nozzle and the bypass water. With the present design a single valve is needed. This both reduces cost and makes training to use the dispenser simpler. A single valve puts the dispenser in operation and ceases dispenser operation.

The present invention is a venturi ejector for forcibly ejecting a slurry generated in a fluid dispenser, wherein the venturi ejector includes a venturi, the venturi being in a first flow communication with the slurry and developing a vacuum, the vacuum being in a second flow communication with atmospheric pressure, the second flow communication acting to cause the atmospheric pressure to exert a pressure on the slurry, thereby forcing the slurry to the venturi where the slurry is forcibly ejected from the venturi. A method for forcibly ejecting a slurry or solution generated in a fluid dispenser is further included.

DETAILED DESCRIPTION OF THE DRAWINGS

Figure 1:
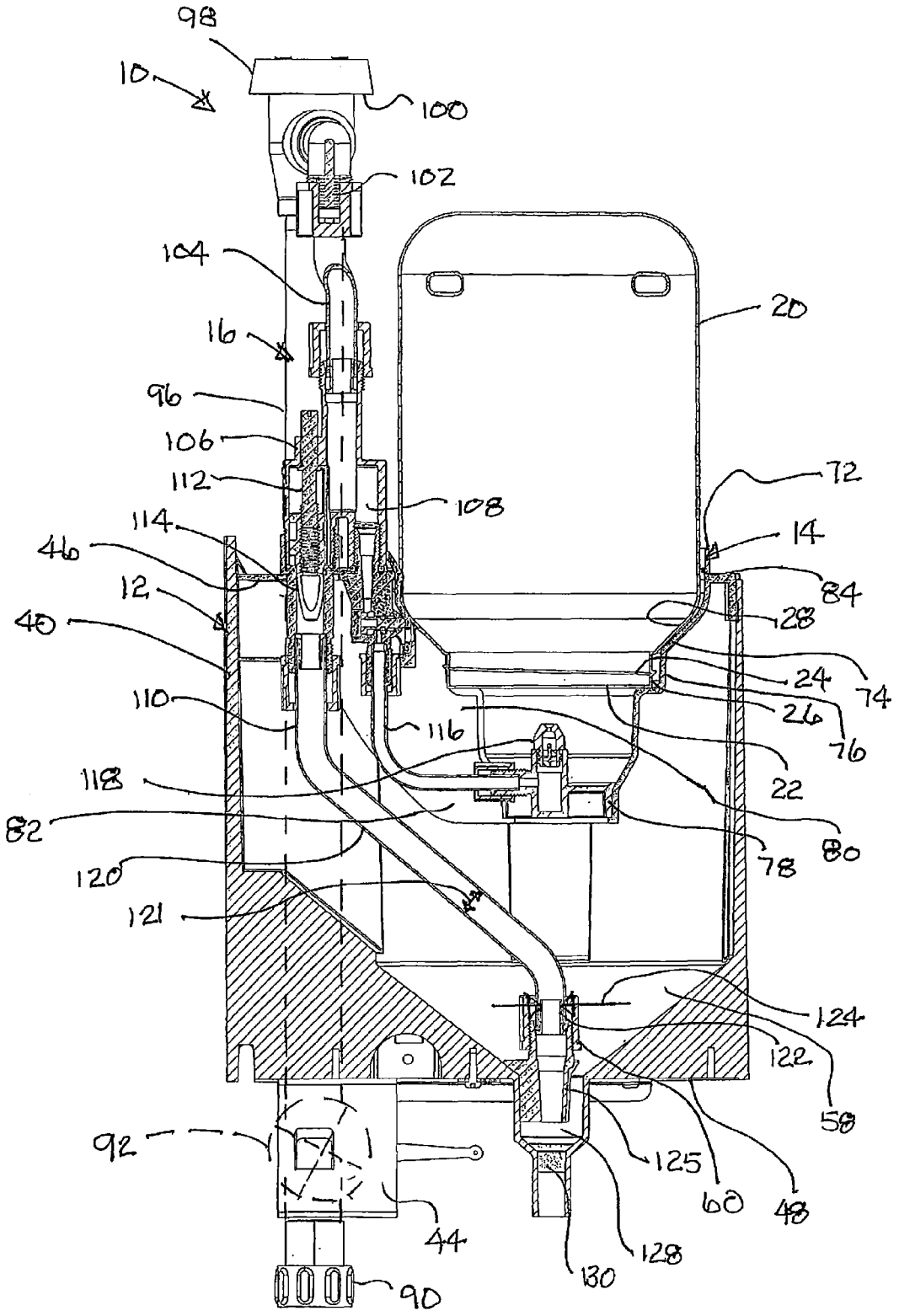
FIG. 1 is a sectional view of the dispenser of the present invention taken along section line A-A of FIG. 2.

Referring to the drawings, a fluid dispenser 10 includes housing 12, bowl 14, and water supply 16. The fluid dispenser 10 is designed to dispense a fluid or a slurry generated from a solid cast detergent. The solid cast detergent is cast in a container 20 as depicted in FIG. 1. The container 20 is inverted in the depiction of FIG. 1. The mouth 22 thereof is opened by removing a spin on/off lid (not shown) that may be threadedly engaged with the threads 24. The container 20 includes a neck 26 adjacent a shoulder 28.

Turning to the first subcomponent of the fluid dispenser 10, the housing 12 includes two major subcomponents, mounting plate 40 and removable cover 54.

Figure 2:
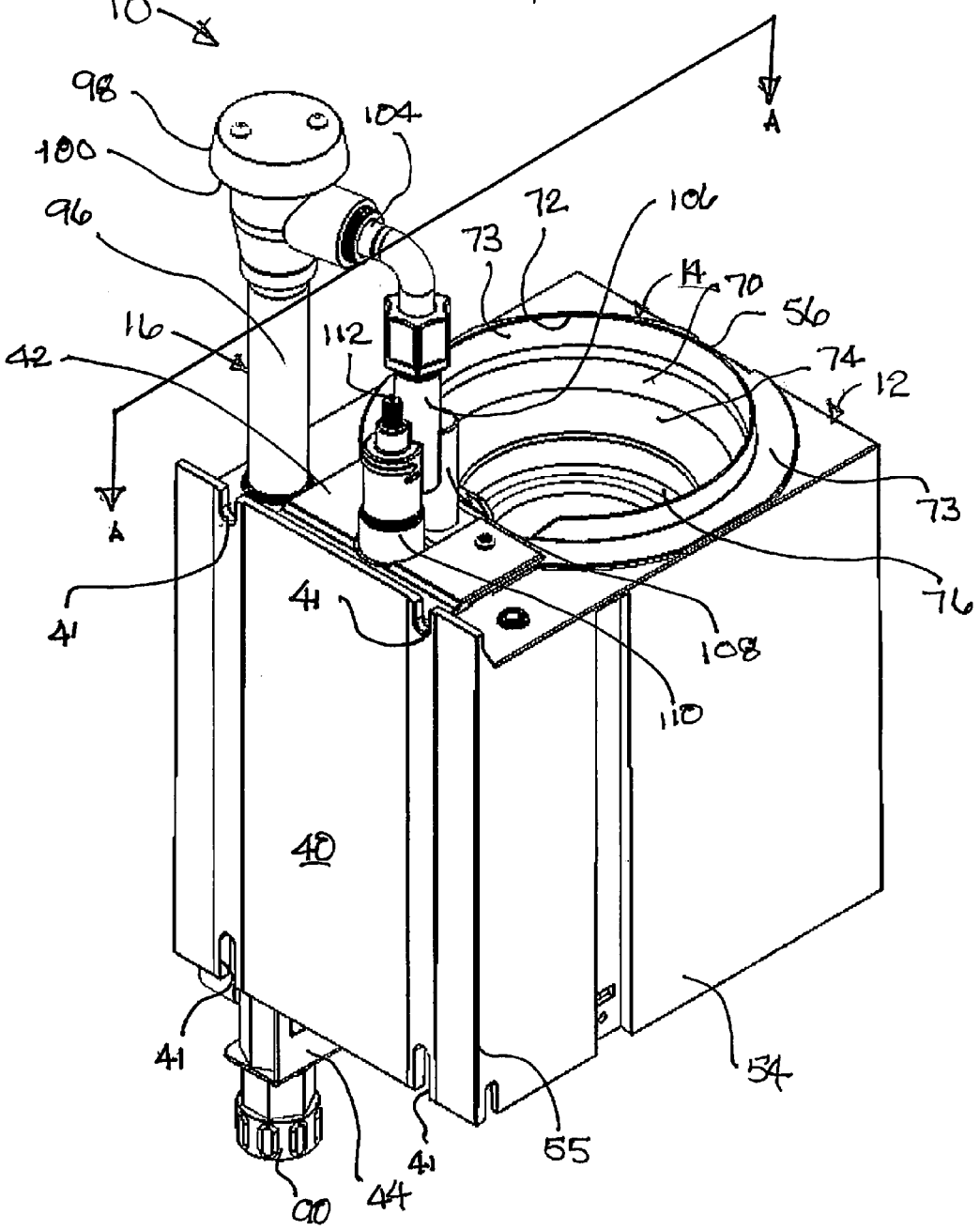
FIG. 2 is a perspective view of the dispenser of the present invention.
Figure 3:
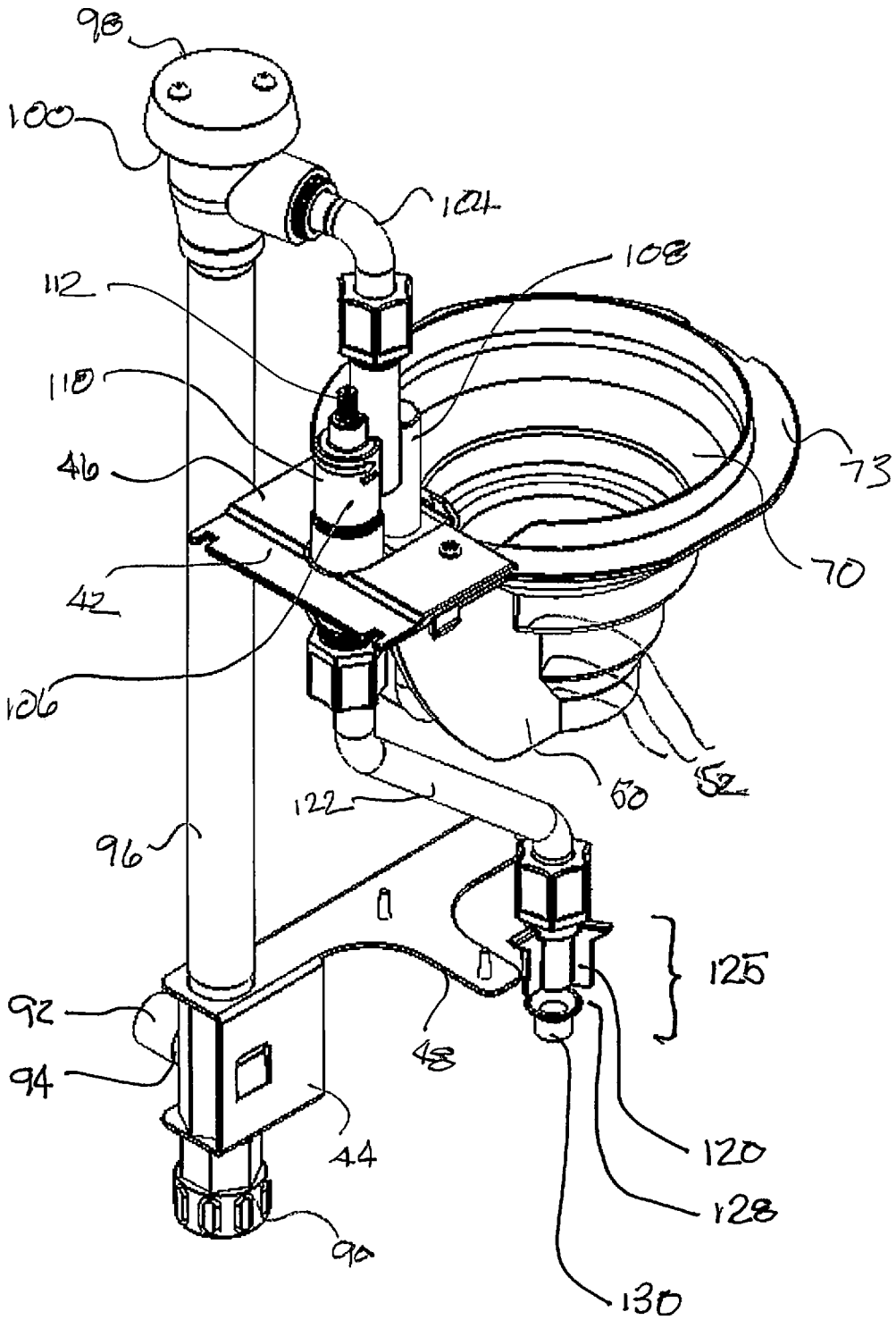
FIG. 3 is a perspective view of the dispenser of the present invention with the housing removed.
Figure 4:
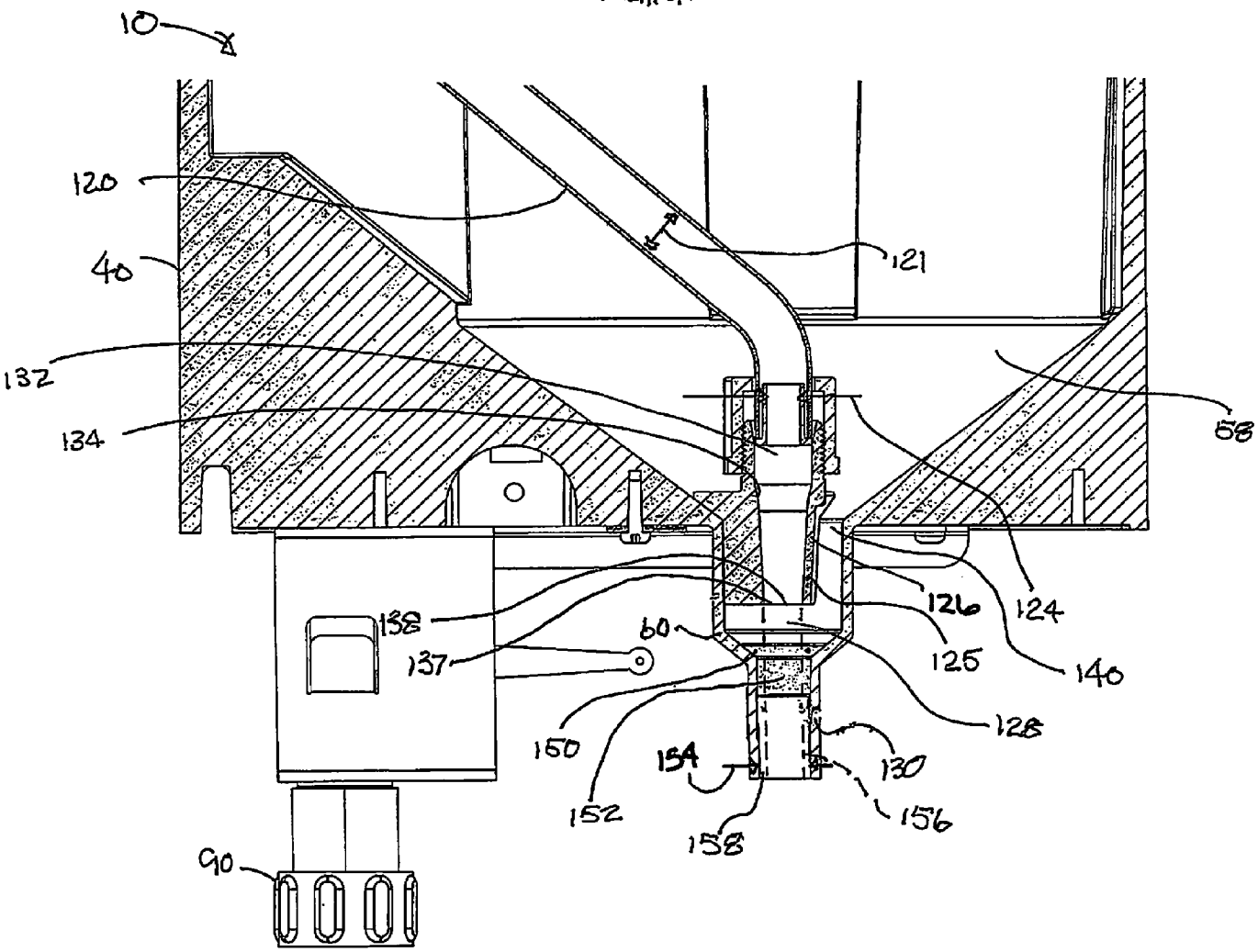
FIG. 4 is a sectional view of the dispenser venturi of the present invention taken along line A-A of FIG. 2.

Referring to FIG. 2, the mounting plate 40 includes a plurality of notches 41 that are adapted to receive a mounting device, such as a screw or the like that may be threaded into a supporting wall. The mounting plate 40 may thereby be fixedly mounted to a supporting wall.

The mounting plate 40 includes a plurality of support elements 42. The first of such support elements 42 is a depending inlet support 44. An additional support element 42 is an upper support plate 46.

Two further support elements 42 are included as part of the mounting plate 40. The support elements 42 include the bottom support plate 48 and the stepped bowl support 50. The stepped bowl support 50 includes a plurality of steps 52 defined thereon.

The second major subcomponent of the housing 12 is the removable cover 54. The removable cover 54 is three sided having an open rear side 55. The removable cover 54 is designed to be readily mated to the mounting plate 40, the open rear side 55 thereby being enclosed. The housing 12 defines a generally cube shape when the mounting plate 40 and the removable cover 54 are mated. The removable cover 54 includes an upward directed bowl support aperture 56.

The removable cover 54 includes a reservoir 58 defined in the lower portion of the removable cover 54. A venturi support 60 is provided at the lowermost portion of the cover 54.

The second major subcomponent of the fluid dispenser 10 is the bowl 14, as depicted in FIGS. 1-4. The bowl 14 is formed in a generally funnel shape 70, having generally inwardly sloping sides as one descends from the open top to the open bottom of the bowl 14. The bowl 14 includes an upward directed detergent container receiver 72. A lip 73 is provided adjacent the upward directed detergent container receiver 72. The sides of the bowl 14 are molded to include a shoulder support 74 and a neck support 76. The shoulder support 74 and a neck support 76 are adapted to respectively support the shoulder 28 and the neck 26 of the container 20 when the container 20 is disposed inverted in the bowl 14.

When installed in the cover 54, the bowl 14 is supported in part by the stepped bowl support 50 and in part by a lip 73 that rests on an edge of the bowl support aperture 56. The lower portion of the bowl 14 defines an accumulator portion 80. A nozzle support 78 is disposed within the accumulator portion 80 adjacent a downward directed flow opening 82. When installed in the cover 54, the downward directed flow opening 82 is in flow communication with the reservoir 58 defined in the cover 54.

It should be noted that an atmospheric pressure passageway 84 is defined between the inner margin of the bowl 14 and the outer margin of the neck 26 and shoulder 28 of the solid cast detergent container 20. This atmospheric pressure passageway 84 is defined circumferential to the solid cast detergent container 20 and admits atmospheric pressure to the accumulator 80 at all times.

Referring now to the water supply 16 of the fluid dispenser 10, as depicted in FIGS. 1-4, flow through the water supply 16 commences at an inlet coupler 90. Preferably, inlet coupler 90 is rotatable for threadedly engaging a hose from a hot water supply in a sink or the like in the manner that a garden hose is coupled to a spigot. It is advantageous to employ warm water from a hot water supply (as distinct from cold water) to better dissolve the cast detergent in the detergent container 20.

Warm water flows from the inlet coupler 90 to the valve 92. Valve 92 is capable of opening or closing fluid flow from the inlet coupler 90 and thereby controls the water supply to the remainder of the water supply 16.

Valve 92 includes a valve neck 94. The valve neck 94 is support by the depending water inlet support 44 of the housing 12.

Valve 92 is fluidly coupled to uptake pipe 96. The uptake pipe 96 is capped at its upper margin with a backflow preventer 98. The backflow preventer 98 includes an air inlet 100 and preferably has an inverted cup valve 102. Water pressure in the uptake pipe 96 acts to open the cup valve 102 and a lack of pressure in the uptake pipe 96 causes air to be admitted to the backflow preventer 98 to the air inlet 100, thereby closing the valve 102 and preventing backflow from entering the uptake pipe 96 and potentially contaminating the facility water supply coupled to the water supply 16. Such backflow preventers 98 are commonly used on fluid dispensers in the prior art.

A down tube 104 is fluidly coupled to the backflow preventer 98 and to the uptake pipe 96. Down tube 104 is fluidly coupled to flow splitter 106.

Flow splitter 106 acts to effectively split the water intake flow into two different channels. The first of such channels is the nozzle supply 108 and the second is the bypass supply 110. A manually adjustable valve control 112 controls a valve (preferably, a reed valve) 114 for adjusting the split of the incoming water between the nozzle supply 108 and the bypass supply 110, as desired.

A nozzle supply tube 116 depends from the nozzle supply 108 and is fluidly connected to an upward directed nozzle 118. The upward directed nozzle 118 is designed to direct a spray of water upon the solid cast detergent within the solid cast detergent container 20 and is supported in place by the nozzle support 78 of the bowl 14.

Referring to FIG. 5, a bypass flow tube 120 fluidly couples the bypass supply 110 to the venturi 125. The bypass flow tube 120 has an inside diameter, $D_1$ 121.

The venturi 125 is fluidly coupled to the distal end of the bypass flow tube 120. The venturi 125 is comprised of a restrictor 126, an inductor 128, and a ejector 130. The restrictor 126 has a transition zone 132 that has a diameter generally equal to $D_1$ 121. The transition zone 132 has a tapered inlet 134 to an interior flow passageway 136. The tapered inlet 134 acts to reduce turbulence in the flow of bypass water, thereby providing for laminar flow through the interior flow passageway 136. The interior flow passageway 136 has an interior diameter equal to $D_2$ 138. Diameter $D_2$ 138 has a lesser dimension than the restrictor diameter $D_1$ 121. Accordingly, the flow velocity of the bypass water through the interior flow passageway 136 is substantially accelerated as compared to the flow velocity of the bypass water in the bypass flow tube 120. The volume of bypass water should be at least 1.5 gpm, with an optimum flow of generally 5.5 gpm in order to generate the desired vacuum.

An exterior flow passageway 140 is defined circumferentially to the restrictor 126 between the outer margin of the restrictor 126 and the inner margin of the venturi support 60. The exterior flow passageway 140 is in flow communication with the accumulator 80 defined in the housing 12. The restrictor 126 has a mouth 137 at the terminal end thereof. The mouth 137 has a diameter $D_2$ 138. It is diameter $D_2$ 138 that defines the diameter of the column of high velocity bypass water 156 (described below) that passes through the ejector 130.

The restrictor 126 is spaced apart from the ejector 130. The inductor 128 is defined in this space between the restrictor 126 and the ejector 130. The inductor 128 is defined by the circumferential space between the restrictor 126 and the ejector 130 and by the inner margin of the venturi support 60. The inductor 128 is in flow communication with the accumulator 80 (and thereby with the reservoir 58) via the exterior flow passageway 140.

The ejector 130 is in bypass water flow communication with the inductor 128. The ejector 130 has a tapered inlet 150 that leads to an elongate flow passageway 152. The elongate flow passageway 152 has an inside diameter $D_3$ 154. $D_3$ 154 is greater than $D_2$ 138. $D_3$ 154 is greater than $D_2$ 138 by between 0.010 and 0.050 inches. Preferably, $D_3$ 154 is greater than $D_2$ 138 by generally 0.020 inches.

A column of high velocity bypass water 156 having a diameter that is substantially $D_2$ 138 emerges from the restrictor 126, passes through the inductor 128, and flows through the center portion of the elongate flow passageway 152 retaining the diameter that is substantially $D_2$ 138. The column of high velocity bypass water 156 remains in the shape of a column as it passes through the elongate flow passageway 152. Accordingly, an annular flow channel 158 is defined between the inner margin of the elongate flow passageway 152 and the outer margin of the column of high velocity bypass water 156. The annular flow channel 158 has a inner diameter that is substantially $D_2$ 138 and an outer diameter defined by the inner margin of the flow passageway 152 equal to $D_3$ 154. This annular flow channel 158 is defined between $D_2$ 138 and $D_3$ 154. The annular flow channel 158 is in flow communication with exterior flow passageway 140.

In operation, the valve 92 is opened to permit the flow of inlet water into the uptake pipe 96. The flow of inlet water proceeds to the flow splitter 106 where it is split in a selected manner between the nozzle supply 108 and the bypass supply 110. The flow in the nozzle supply 108 proceeds to the upward directed nozzle 118 wherein an upward directed spray of water is directed on the solid cast chemical exposed in the inverted detergent container 20. This spray generates a slurry solution that is comprised of the water emerging from the upward directed nozzle 118 and dissolved cast detergent from the container 20. The solution flows downward through the accumulator 80 and out the flow opening 82 and into the reservoir 58.

Simultaneously, bypass water flows through the bypass supply 110 to the venturi 125. Flow of the bypass water is accelerated by the restrictor 120 and a column of high speed bypass water shaped by flows through the inductor 128 and enters the ejector 130. The column of high velocity bypass water 156 passing through the ejector 130 generates a high vacuum in the annular flow channel 158. This high vacuum is transmitted to the reservoir 58 and the accumulator 80. Atmospheric pressure acts through the atmospheric pressure passageway 84 on the solution developed in both the accumulator 80 and the reservoir 58. The solution is forced down into the inductor 128 through the exterior flow passageway 140. The flow of solution is forced into the annular flow channel 158 where it is mixed with the column of high velocity bypass water 156 and forcibly ejected from the distal end of the ejector 130.

Typically, a hose (not shown) is clamped to the exterior margin of ejector 130 for delivery of the flow to a bucket or the like. The forcibly ejected flow from the distal end of the ejector 130 has sufficient velocity to be carried by such a hose to an elevation that is higher than the mounted elevation of the fluid dispenser 10 or the flow may be transported a significant distance in the hose. The forcible ejection from the distal end of the ejector 130 and the cleansing caused atmospheric pressure acting on the solution acts to cleanse the venturi, the reservoir 58 and the accumulator 80, thereby minimizing any solidifying of solution in the aforementioned structures and clogging such structures.

The invention claimed is:

1. A chemical dispenser configured to dispense a dissolved solid cast chemical solution at a pressure sufficient to enable transportation of the solution through a fluid conduit at heights that exceed the height of the dispenser, the dispenser comprising:

a single supply valve acting to selectively enable the flow of a pressurized water supply;

a flow splitter acting to split the pressurized water supply into a first fluid flow and a second fluid flow, wherein the flow splitter includes a manually adjustable valve configured to selectively adjust the split of the pressurized water supply between the first fluid flow and the second fluid flow, wherein the first fluid flow is diverted to dissolve a solid cast chemical to form a first fluid flow slurry or solution, and the second fluid flow continues along a path through a high flow rate solid cast chemical bypass;

a housing including a support surface configured to receive a solid cast chemical container, a collection reservoir configured to collect the first fluid flow slurry or solution, and an atmospheric pressure passageway present between the support surface and the container configured to equalize the pressure of the collection reservoir with the pressure of the surrounding atmosphere; and a venturi configured to combine the first fluid flow slurry or solution with the second fluid flow, wherein passage of the second fluid flow through the venturi creates a vacuum to pull the first fluid flow slurry or solution from the atmospheric pressure equalized collection reservoir for combination with the second fluid flow, thereby forming a single stream of dissolved solid cast chemical solution, wherein the venturi is vertically oriented at the bottom of the collection reservoir directly below the container.

2. The chemical dispenser of claim 1, wherein the manually adjustable valve is a reed valve.

3. The chemical dispenser of claim 1, wherein the venturi includes a restrictor and an ejector, the restrictor and the ejector being spaced apart to in part define an inductor.

4. The chemical dispenser of claim 3, wherein the inductor is in flow communication with the first fluid flow slurry or solution.

5. The chemical dispenser of claim 4, wherein the restrictor has a restrictor flow passageway, the flow passageway being in flow communication with the second fluid flow, the restrictor acting to accelerate the velocity of the second fluid flow as the second fluid flow passes through the flow passageway.

6. The chemical dispenser of claim 5, wherein the second fluid flow is between about 1.5 gallons per minute and about 5.5 gallons per minute.

7. The chemical dispenser of claim 5, wherein the second fluid flow is about 5.5 gallons per minute.

8. The chemical dispenser of claim 5, wherein the ejector has an ejector flow passageway defined therethrough, the ejector flow passageway being in flow communication with the restrictor flow passageway for receiving the combination of the first fluid flow slurry or solution and the second fluid flow, so as to form the single stream of dissolved solid cast chemical solution.

9. The chemical dispenser of claim 8, wherein the ejector flow passageway has a diameter that is greater than a diameter of the restrictor flow passageway.

10. The chemical dispenser of claim 9, wherein an annular space is defined between an outer margin of the second fluid flow and an inner margin of the ejector flow passageway.

11. The chemical dispenser of claim 10, wherein the vacuum is developed in the annular space as a result of the passage of the second fluid flow through the ejector flow passageway.

12. The chemical dispenser of claim 11, wherein the annular space is in flow communication with an inductor, the inductor being defined between the restrictor and the ejector, the inductor further being in flow communication with the first fluid flow slurry or solution, the vacuum acting on the first fluid flow slurry or solution for mixing the first fluid flow slurry or solution with the second fluid flow in the ejector flow passageway and for ejecting the single stream of dissolved solid cast chemical solution from the venturi.

13. The chemical dispenser of claim 1, further comprising a backflow preventer to inhibit a backflow of dissolved solid cast chemical into the water supply in the event of a loss of pressure.

14. The chemical dispenser of claim 1, wherein the first fluid flow is directed at the solid cast chemical via a nozzle.

15. A method for forcibly ejecting a slurry or solution generated in a fluid dispenser, comprising:

selectively actuating a single supply valve thereby putting the dispenser in operation and enabling the flow of a pressurized water supply;

splitting the pressurized water supply into a first fluid flow and a second fluid flow, wherein the pressurized water supply is split via a manually adjustable valve configured to selectively adjust the split of pressurized water supply between the first fluid flow and the second fluid flow;

forming a first fluid flow slurry or solution by means of the first fluid flow acting on a solid cast chemical contained within a solid cast chemical container supported by a housing support surface;

collecting the first fluid flow slurry or solution in a collection reservoir, wherein the pressure of the collection reservoir is equalized with the pressure of the surrounding atmosphere by an atmospheric pressure passageway present between the support surface and the container; and developing a vacuum by means of passing the second fluid flow through a venturi to pull the first fluid flow slurry or solution from the atmospheric pressure equalized collection reservoir for combination with the second fluid flow, thereby forming a single stream of dissolved solid cast chemical solution, wherein the venturi is vertically oriented at the bottom of the collection reservoir directly below the container.

16. The method of claim 15, wherein the manually adjustable valve is a reed valve.

17. The method of claim 15, further including forming a restrictor and an ejector and spacing the restrictor and the ejector apart to in part define an inductor.

18. The method of claim 17, further including placing the inductor in flow communication with the first fluid flow slurry or solution.

19. The method of claim 18, further including forming a restrictor flow passageway in the restrictor, placing the flow passageway in flow communication with the second fluid flow, and causing the restrictor to accelerate the velocity of the second fluid flow as the second fluid flow passes through the flow passageway.

20. The method of claim 19, further including causing the second fluid flow to be between about 1.5 gallons per minute and about 5.5 gallons per minute.

21. The method of claim 20, further including causing the second fluid flow to be about 5.5 gallons per minute.

22. The method of claim 15, further including defining an annular space between an outer margin of the second fluid flow and an inner margin of an ejector flow passageway, causing the passage of the second fluid flow through the ejector flow passageway, and thereby developing a vacuum in the annular space.

23. A chemical dispenser comprising:

a supply valve configured to selectively enable the flow of a pressurized water supply;

a flow splitter configured to split the pressurized water supply into a first fluid flow and a second fluid flow, wherein the first fluid flow dissolves a solid cast chemical to form a first fluid flow slurry or solution, and the second fluid flow bypasses the solid cast chemical;

a housing having a support surface configured to receive a solid cast chemical container, a collection reservoir configured to collect the first fluid flow solid cast chemical solution, and a an atmospheric pressure passageway present between the support surface and the container configured to equalize the pressure of the collection reservoir with the pressure of the surrounding atmosphere; and a venturi configured to create a vacuum to pull the first fluid flow solid cast chemical solution from the atmospheric pressure equalized collection reservoir for combination with the second fluid flow, thereby forming a single stream of dissolved solid cast chemical solution, wherein the venturi is vertically oriented at the bottom of the collection reservoir directly below the container.

* * * * *